United States Patent [19]

Liu

[11] Patent Number: 4,965,422

[45] Date of Patent: Oct. 23, 1990

[54] PRESSURE DRIVING CUT-OFF TYPE MANOMETER

[76] Inventor: Miu-Tsu Liu, No. 15, Fu Chou 8 Street, Chia Yi City, Taiwan

[21] Appl. No.: 344,561

[22] Filed: Apr. 28, 1989

[51] Int. Cl.[5] ..... H01H 35/34

[52] U.S. Cl. ..... 200/83 S; 73/723; 200/83 R

[58] Field of Search ..... 200/308, 81 R, 83 R, 200/83 S; 91/1; 92/5 R; 307/118; 73/717, 723; 340/626

[56] References Cited

U.S. PATENT DOCUMENTS

| | | | |
|---|---|---|---|
| 3,444,341 | 5/1969 | Mighton | 200/835 |
| 4,456,801 | 6/1984 | Lauritsen | 200/835 |
| 4,626,636 | 12/1986 | Hickman | 200/835 |
| 4,644,116 | 2/1987 | Miyakawa | 73/723 |
| 4,724,289 | 2/1988 | Heissler | 200/835 |

*Primary Examiner*—Gerald P. Tolin

*Attorney, Agent, or Firm*—Schwartz & Weinrieb

[57] ABSTRACT

A manometer device comprising a pointer to be fixed on a scale, a screw to be used to fix the pointer, and a sliding carriage cooperates with the screw; a pair of contacts are bolted on the lower surface of the sliding carriage. The two contacts can be used to connected with a fluid driver, and there is a pressure induction mechanism under the contacts which has a needle to thrust the contact point. With this mechanism, the center of the pressure induction mechanism would thrust the contact point open to cut off the current in the circuit while the pressure in the space to be measured reaches the pressure demonstrated by the pointer, and then the fluid driver would stop to act.

6 Claims, 2 Drawing Sheets

PRESSURE DRIVING CUT-OFF TYPE MANOMETER

BACKGROUND OF THE INVENTION

The present invention relates to a manometer device, and more particularly to a manometer which can be applied to connect with the fluid drivers, such as, air compressor, pump, . . . etc. and which can determine the pressure in the space to be measured. While the pressure in the space to be measured reaches the setting value, it would cause the circuit of power supply open to cut-off the circuit of the fluid driver automatically.

The manometer has a wide range of uses, for example, it is required by various chemical factories, manufacturing factories, assembly plants, . . . etc. The general manometers are used solely to measure the pressures of fluids, they are unable to be connected to act with the controller of power supply and fluid drivers (such as air compressors or pumps . . . etc.), under such circumstances while the pressures in the spaces to be measured, such as steam piping, etc., exceeded the setting value, the fluid drivers, etc. are still in act continuously, it results in the pressure in the spaces to be measured exceed the setting value and accidents incurred at last. Meanwhile, the structure of manometer generally used is extremely complicated, it is easy to cause trouble and besides, the cost of manometer is higher.

SUMMARY OF THE INVENTION

In view of the above shortcomings of the manometers commonly used, the main object of the present invention is to provide a manometer which can be connected with air compressor or pump and a pressure might be defined, and the pressure is variable. While the pressure in the space to be measured exceeds the setting value, the circuit of the fluid driver would open and the fluid driver would stop to act to maintain a constant pressure inside the space to be measured to attain security.

The structure of the above manometer is simple with less components, so its cost is lower and is not easily to incur troubles.

The present invention will become more readily apparent from the following description of the preferred embodiment of the present invention taken in conjunction with the accompanying drawings.

DETAILED DESCRIPTION OF THE PREFERRED EMBODIMENTS

Figure 1:
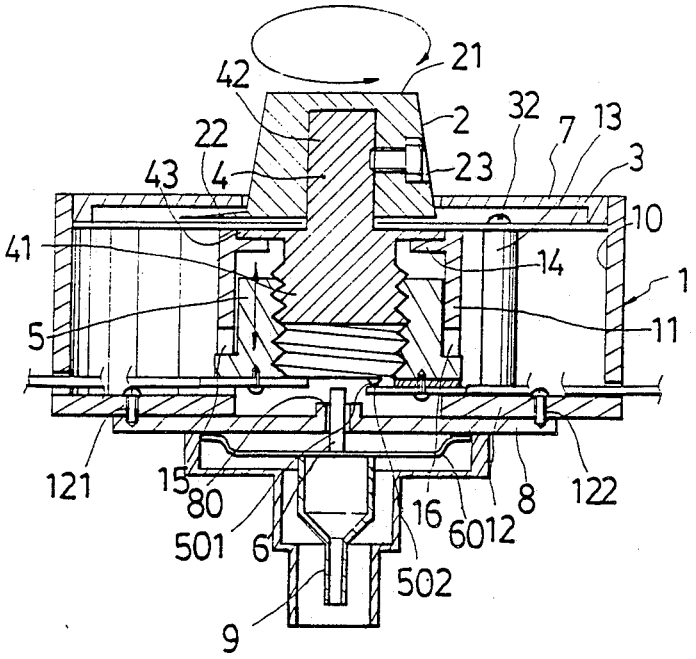
FIG. 1 is a sectional view of the present invention.
Figure 2:
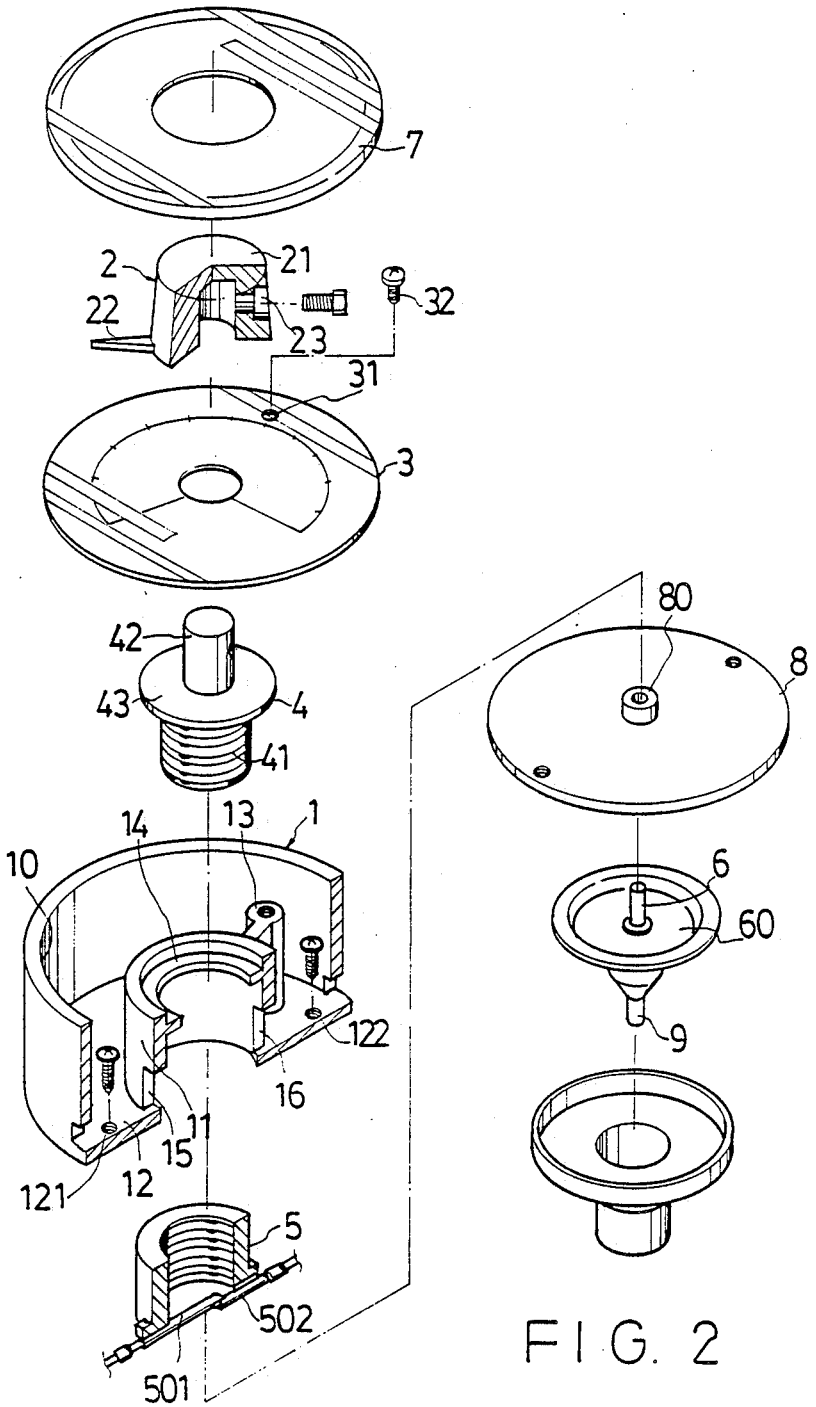
FIG. 2 shows the components of the structure of the present invention.

Referring to the FIGS. 1 and 2, the pressure device of the present invention includes a case 1, a pointer 2, a scale board 3, a screw 4, a sliding carriage 5, a needle 6 and pressure damper 8, wherein, the case is hollow and to be used for containing components, it can be formed as a short cylinder. There is a circular tube 11 in its central part and a base plate 12 is then formed between the base of the circular tube 11 and the inner wall of the cover 10 of the case 1. The external wall of the circular tube 11 forms an outwardly extending cotter tube 13, and there is inwardly extending loop shaped flange 14 on the inner wall of the top of the circular tube 11. On the bottom of the circular tube 11, there are a pair of openings 15, 16 installed on the bottom board 12, and a multiple screw holes 121, 122, . . . are also can be formed. Pointer 2 is in cap shape with cored bottom, the tip 22 of the pointer is formed on the peripheral of the cap shape body 21, and there is a screw hole 23 on the cap shaped body 21. The scale board 3 is a circular board, there are a lot of dense scales around the peripheral of the surface of the board to indicate the pressure. There is also a hole 31 on the scale board 3, for a screw 32 to bolt into cotter tube 13 on the circular tube 11 of the case 1 to fix the scale board 3.

There is a screw 4 inside the circular tube 11, the screw 4 is divided into two sections, the lower section with larger external diameter of the screw is a screw post 41 and has screw thread on it, the upper section of the screw is a post 42. There is a plate 43 between the screw post 41 and the post 42, then the screw 4 to be stopped on the loop shape flange 14 on the top of the circular pipe 11 in the middle of the case 1. Inside the circular tube 11, there is a sliding carriage 5 to fasten up with the screw post 41 of the screw 4. The sliding carriage 5 is also in circular tube shape, its inner wall also has screw threads to fasten up with the screw post 41. There are a pair of electric switch contacts 501 and 502 on the bottom of the sliding carriage 5 facilitate to lead electric wires to be connected with the fluid drivers, such as, air compressors and pumps . . . etc. The fluid drivers are able to match with additional power control, etc. (not shown).

While the above components were installed inside the case 1, a transparent cover 7 is installed on the top of the case 1, and a pressure damper 8 is bolted on the bottom of the case 1. There is also a hole 80 in the middle of the pressure damper 8 to let the needle 6 penetrate the pressure damper 8 from the bottom. The base of needle 6 is integrated with a diaphram 60 and the external edge of diaphram 60 is fixed on the lower part of the pressure damper 8 and a thrust body 9 might be installed on the lower part of the diaphram.

Figure 3:
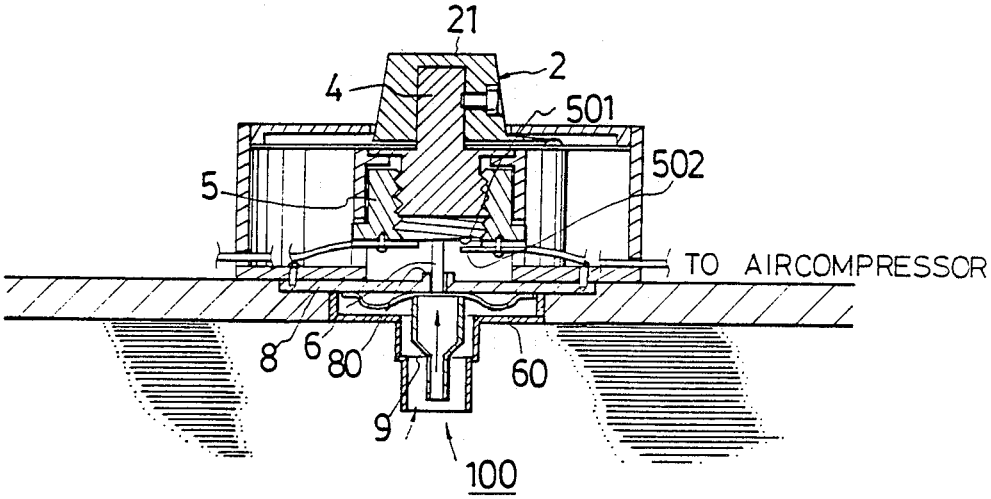
FIG. 3 is the illustration of the practicality of the present invention.

Refer to FIG. 3, in using the present invention, the thrust body 9 on the bottom of the present invention is exposed to the pressure in the space to be measured, and the space to be measured maintains the state of the switch strictly closed. On turning the cap-shaped body 21 of the pointer 2 to make the pointer 2 point to the scale to represent the setting pressure, the cap shaped body 21 of pointer 2 would cause the screw 4 integrated with the cap shaped body to turn, and the screw 4 thrusts sliding carriage 5 bolted with it to move up and down; under such circumstances, the distance between the needle 6 and the contacts 501, 502 might be changed and the above distance to be proportional to the value of the pressure pointed by the pointer. While the fluid in the space 100 to be measured comes in from the thrust body to push the diaphram 60, the needle 6 would extend out of the hole 80 of the pressure damper 8; while the pressure inside the space 100 to be measured would increase gradually due to the action of the fluid driver, the needle 6 is thrusted to extrude upward gradually; while it thrusts the electric contact points 501, 502 apart, the circuit would be turned off, the fluid driver becomes ineffective and the pressure of the fluid inside the space to be measured reaches a constant value and it would not go up continuously any longer.

Based on the above description, the manometer of the present invention ensures that the pressure inside the space to be measured will not go up continuously, it offers a safeguard for security in the industrial world.

Obviously, many modifications and variations of the present invention are possible in light of the above teachings. It is therefore to be understood that within the scope of the appended claims, the present invention may be practiced otherwise than as specifically described herein.

I claim:

1. A manometer device, comprising:

a case for containing components and inside of which is installed a circular tube;

a pointer comprising a cap-shaped body with a cored bottom, and a tip formed upon a peripheral portion of said cap-shaped body;

a scale board fixed upon said case and having scale means disposed upon an upper surface portion thereof for visual cooperation with said pointer tip;

a screw body divided into two sections, one with screw threads extending into said circular tube of said case, and a second section without screw threads having said cored bottom of said pointer fixed thereon;

a sliding carriage comprising a circular tube which is threadedly engaged with said screw threads of said one section of said screw body;

an electrical switch comprising a pair of electrical contacts fixed upon a bottom portion of said sliding carriage and operated by fluid pressure;

a pressure damper fixedly secured upon a bottom portion of said case and having a hole defined therethrough; and a needle freely penetrating through said hole defined within said pressure damper, a base portion of said needle being connected to a diaphragm which is mounted upon a bottom portion of said pressure damper;

characterized in that when said screw body is moved by turning said pointer to a predetermined pressure value, upon said scale means of said scale board, which is to be sensed by said manometer, said sliding carriage is caused to move up and down such that the distance between said electrical contacts of said switch and said needle is adjusted whereby when said fluid pressure coming from a fluid source, and to be measured, reaches said predetermined value, said electrical contacts are opened by means of said needle so as to terminate electrical power to said fluid source.

2. A manometer device as claimed in claim 1, wherein a bottom portion of said diaphragm has a thrust surface.

3. A manometer device as claimed in claim 1, wherein the top of the circular tube inside the case has an inward extending flange for supporting an annular flange portion of said screw body interposed between said one threaded section and said second non-threaded section.

4. A manometer device as claimed in claim 1, wherein the bottom of the circular tube inside the case has a pair of openings for operatively cooperating with a pair of outward projections formed upon said sliding carriage whereby rotation of said sliding carriage, relative to said case, is prevented in response to said turning of said pointer and said screw body yet said up and down movement of said sliding carriage is permitted.

5. A manometer device as set forth in claim 1, wherein:

said case comprises a tubular housing annularly surrounding said circular tube such that an annular space is defined between said circular tube and said tubular housing; and an upstanding post is disposed within said annular space for fixedly securing said scale board upon said case.

6. A manometer device as set forth in claim 1, further comprising:

annular transparent cover means fixedly secured within an upper portion of said case and annularly surrounding said cap-shaped body of said pointer so as to permit said pointer to be freely turned relative to said scale board and yet permitting visual viewing of said scale board and said pointer tip.

* * * * *